US006595801B1

(12) United States Patent
Leonard et al.

(10) Patent No.: US 6,595,801 B1
(45) Date of Patent: Jul. 22, 2003

(54) ELECTRICAL CONNECTOR WITH ELECTRICALLY ISOLATED ESD AND EMI SHIELDS

(75) Inventors: Russell J. Leonard, Naperville, IL (US); Michael J. Gardner, Pleasanton, CA (US)

(73) Assignee: Molex Incorporated, Lisle, IL (US)

( * ) Notice: Subject to any disclaimer, the term of this patent is extended or adjusted under 35 U.S.C. 154(b) by 904 days.

(21) Appl. No.: 08/866,395

(22) Filed: May 30, 1997

(51) Int. Cl.[7] ..... H01R 13/648
(52) U.S. Cl. ..... 439/607
(58) Field of Search ..... 439/607, 608, 439/609, 610, 939

(56) References Cited

U.S. PATENT DOCUMENTS

| | | | | | |
|---|---|---|---|---|---|
| 4,392,708 | A | | 7/1983 | Bailey et al. | 339/182 R |
| 4,582,384 | A | | 4/1986 | Frantz et al. | 339/143 R |
| 4,585,292 | A | | 4/1986 | Frantz et al. | 339/143 R |
| 4,689,723 | A | | 8/1987 | Myers et al. | 361/424 |
| 4,708,412 | A | | 11/1987 | Himes, Jr. et al. | 439/95 |
| 4,894,026 | A | * | 1/1990 | Dixon et al. | 439/609 |
| 4,913,664 | A | * | 4/1990 | Dixon et al. | 439/607 |
| 4,983,127 | A | * | 1/1991 | Kawai et al. | 439/79 |
| 5,035,651 | A | * | 7/1991 | Dixon et al. | 439/609 |
| 5,035,652 | A | * | 7/1991 | Shibano | 439/610 |
| 5,041,022 | A | | 8/1991 | Sekiguchi | 439/609 |
| 5,055,068 | A | | 10/1991 | Machura et al. | 439/581 |
| 5,059,140 | A | | 10/1991 | Philippson et al. | 439/607 |
| 5,104,326 | A | | 4/1992 | Smith et al. | |
| 5,234,356 | A | * | 8/1993 | Maejima et al. | 439/352 |
| 5,562,497 | A | * | 10/1996 | Yagi et al. | 439/610 |
| 5,823,824 | A | * | 10/1998 | Mitamura et al. | 439/585 |

FOREIGN PATENT DOCUMENTS

| | | | |
|---|---|---|---|
| EP | 0 096 570 | 6/1983 | G02B/7/11 |
| EP | 0 370 833 | 11/1989 | H01R/13/658 |
| JP | 07245153 | 9/1995 | H01R/12/648 |

OTHER PUBLICATIONS

European Patent Office Search Report.
Packaging Ideas, Electronic Packaging & Production, Jan. 1995.
IEEE Standards Draft .752 dated Jan. 28, 1997.

* cited by examiner

*Primary Examiner*—P. Austin Bradley
*Assistant Examiner*—Ross Gushi
(74) *Attorney, Agent, or Firm*—Robert J. Zeitler; Charles S. Cohen

(57) ABSTRACT

A shielded electrical connector includes a dielectric housing having a forward mating end and a rearward end. A front ESD shield is disposed about the exterior of at least a substantial portion of the forward mating end of the dielectric housing. A rear EMI shield is disposed about the exterior of at least a substantial portion of the rearward end of the dielectric housing. The front ESD shield is electrically isolated from the rear EMI shield by an outwardly projecting portion of the dielectric housing physically separating the shields. The shielded electrical connector is adapted for mating with a complementary mating connector which includes a peripheral metal shield. A latch arm is folded back from a forward end of the peripheral metal shield of the mating connector for engaging a latch member inside the forward mating end of the dielectric housing of the shielded electrical connector.

26 Claims, 8 Drawing Sheets

ELECTRICAL CONNECTOR WITH ELECTRICALLY ISOLATED ESD AND EMI SHIELDS

FIELD OF THE INVENTION

This invention generally relates to the art of electrical connectors and, particularly, to an electrical connector having ESD and EMI protection.

BACKGROUND OF THE INVENTION

Electrical connectors are used in a wide variety of applications. Some connectors simply are used to transmit power from a power source to an appropriate appliance. Other electrical connectors are used to interconnect signal transmission lines to printed circuit boards, other electronic devices or to other complementary connectors. The transmission lines transmit signals through a plurality of conductors which, preferably, are physically separated and electromagnetically isolated along their length. Hybrid connectors are known in which both power and signals and/or data are transmitted through the connector interface.

Some electrical connectors also employ various types of shield structures, ground structures or the like to protect or to electrically interact with the transmission lines and their terminals within the connectors. For instance, some connectors are provided with shield structures to protect against electrostatic discharges (ESD) which are generated when the connector comes into contact with another conductive body which may be a complementary mating connector. In essence, the ESD shield is used to dissipate static charges.

Connectors also may have shield structures to protect against electromagnetic interference (EMI). In essence, the EMI shield protects the electrical circuitry from externally generated radiated emissions as well as preventing electromagnetic interference from radiating outwardly of the connector.

Typically, ESD and EMI shields are provided by stamped and formed conductive sheet metal components which conventionally surround the connector housing. The metal shield may be a one-piece structure or a multi-part structure with the multiple parts of the shield being in positive engagement. Such shielding structures often act as both an ESD shield as well as an EMI shield. In some instances, a pair of metal shields may be separated from each other by portions of the dielectric connector housing, but, in these instances, one of the shields is located substantially internally of the connector.

Heretofore, the fact that a one-piece shield or a multi-part shield acted both as an ESD shield as well as an EMI shield did not make much difference, because the connectors were provided primarily for signal transmission purposes. In other words, the dissipation of minor static charges did not cause any problem with grounding the EMI shield, even grounding the shield to a circuit board to which the connector is attached.

However, with the advent of what are called "combo" electrical connectors, combined ESD and EMI shield have caused problems. A combo connector is an electrical connector which incorporates the combination of both signal transmission lines/terminals and power lines/terminals in the single connector. If the ESD shield and the EMI shield in a combo connector are commoned to each other or are grounded to a common source, such as a printed circuit board, an electrical discharge from one of the power lines/ terminals could damage the printed circuit board or even overload the circuitry. There is a need for a simple grounding system to solve these problems, wherein the ESD ground means is electrically isolated from the EMI ground means for use in such electrical connectors as combination power and signal connectors, without the system being unduly complicated. Preferably, the system would involve the standard components of the electrical connector without requiring additional extraneous grounding apparatus. The present invention is directed to satisfying this need and solving the problems outlined above.

SUMMARY OF THE INVENTION

An object, therefore, of the invention is to provide an electrical connector with a new and improved shielding system wherein the ESD shield and the EMI shield are electrically isolated from each other.

In the exemplary embodiment of the invention, the electrical connector includes a dielectric housing having a forward mating end and a rearward end. A front ESD shield is disposed about the exterior of at least a substantial portion of the forward mating end of the dielectric housing. A rear EMI shield is disposed about the exterior of at least a substantial portion of the rearward end of the dielectric housing. The front ESD shield is electrically isolated from the rear EMI shield by an outwardly projecting portion of the dielectric housing physically separating the shields. Therefore, no extraneous insulating components whatsoever are required.

As disclosed herein, the forward mating end of the housing includes a receptacle portion for receiving a plug portion of a complementary mating connector. The front ESD shield is disposed about the receptacle portion, whereby the receptacle portion forms a dielectric barrier between the ESD shield and the plug portion of the complementary mating connector. As disclosed, the receptacle portion is generally rectangular, and the ESD shield includes a rectangular shroud surrounding the rectangular receptacle portion.

A feature of the invention is that the front ESD shield includes at least one retention portion for locking the shield to the outwardly projecting portion of the dielectric housing. In the preferred embodiment, the outwardly projecting portion is formed as a peripheral flange. The ESD shield includes at least one retention tab embracing the peripheral flange for fixing the ESD shield to the housing.

The invention is disclosed herein in a shielded electrical connector adapted for mounting on a printed circuit board and through an aperture in a conductive bracket. The front ESD shield is adapted for engaging the conductive bracket about the aperture therein. The rear EMI shield has ground means adapted for engaging a ground circuit on the printed circuit board.

The shielded electrical connector is adapted for mating with a complementary mating connector which includes a peripheral metal shield. Complementary interengaging latch means is provided between the peripheral shield of the mating connector and the dielectric housing of the shielded electrical connector. The complementary interengaging latch means includes a latch arm folded back from a forward end of the peripheral metal shield for engaging a latch member inside the forward mating end of the dielectric housing.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims.

The invention, together with its objects and the advantages thereof, may be best understood by reference to the following description taken in conjunction with the accompanying drawings, in which like reference numerals identify like elements in the figures and in which.

DETAILED DESCRIPTION OF THE PREFERRED EMBODIMENT

Figure 1:
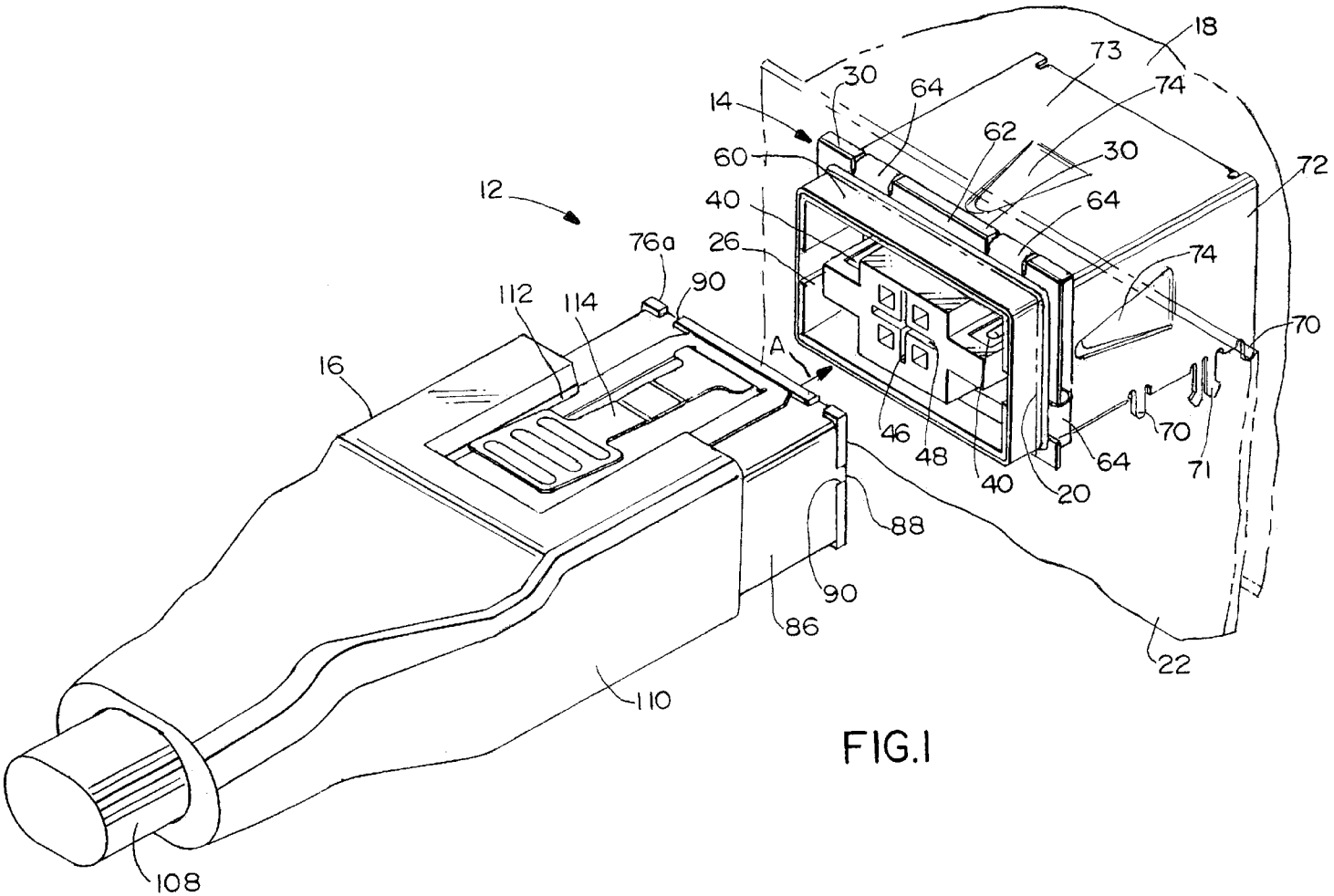
FIG. 1 is a perspective view of a connector assembly including a receptacle connector and a plug connector, the receptacle connector incorporating the concepts of the invention.
Figure 2:
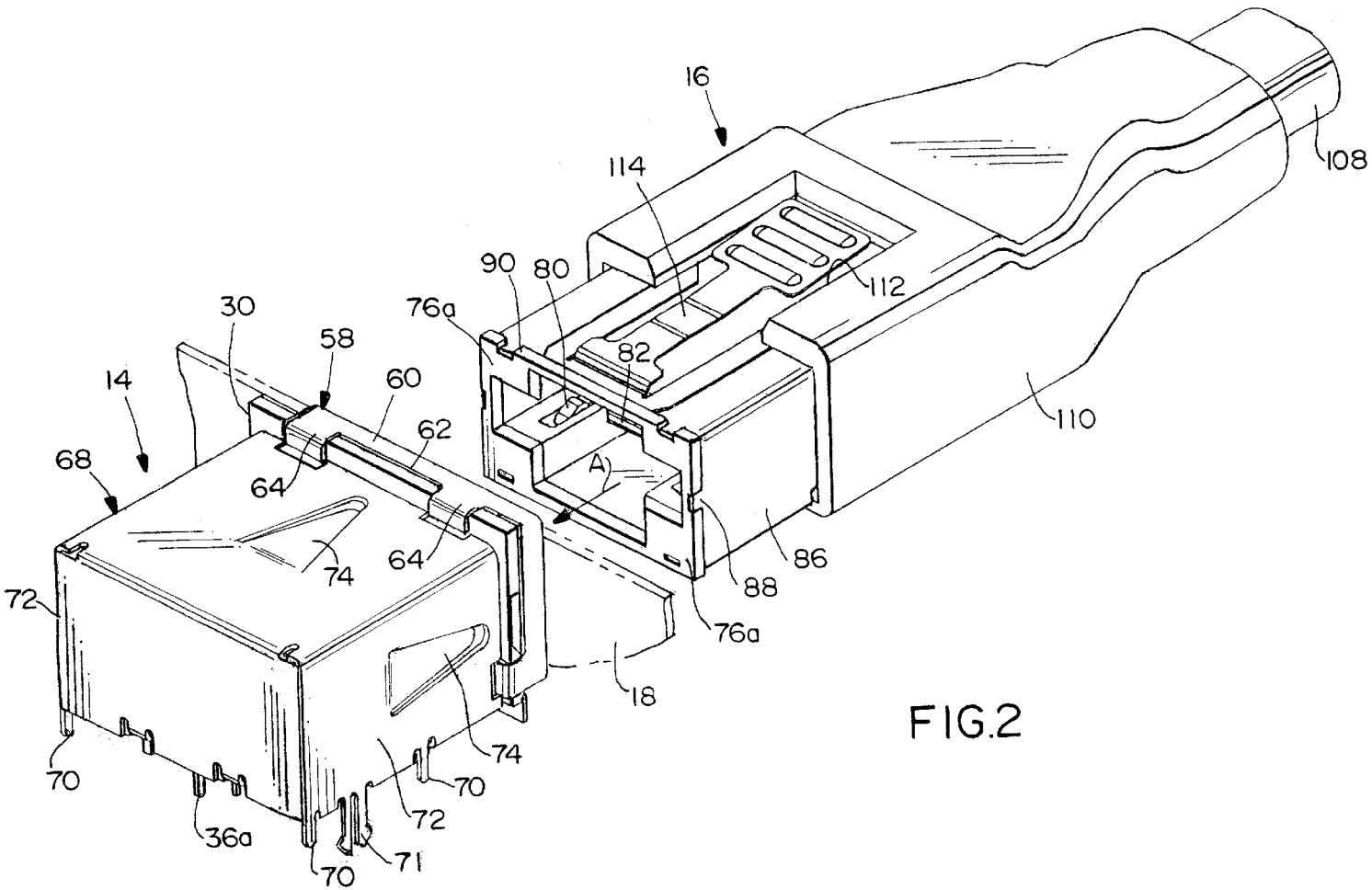
FIG. 2 is a perspective view of the connector assembly taken 180° from the direction of FIG. 1.

Referring to the drawings in greater detail, and first to FIGS. 1 and 2, an electrical connector assembly, generally designated 12, is shown to include a receptacle connector, generally designated 14, and a plug connector, generally designated 16. Plug connector 16 is insertable into receptacle connector 14 in the direction of arrow "A. Receptacle connector 14 is adapted for mounting on the top of a printed circuit board 18. The front end of the receptacle connector is adapted for mounting through an aperture 20 in a conductive bracket 22 which may form part of a chassis with which the connector assembly is associated.

Figure 3:
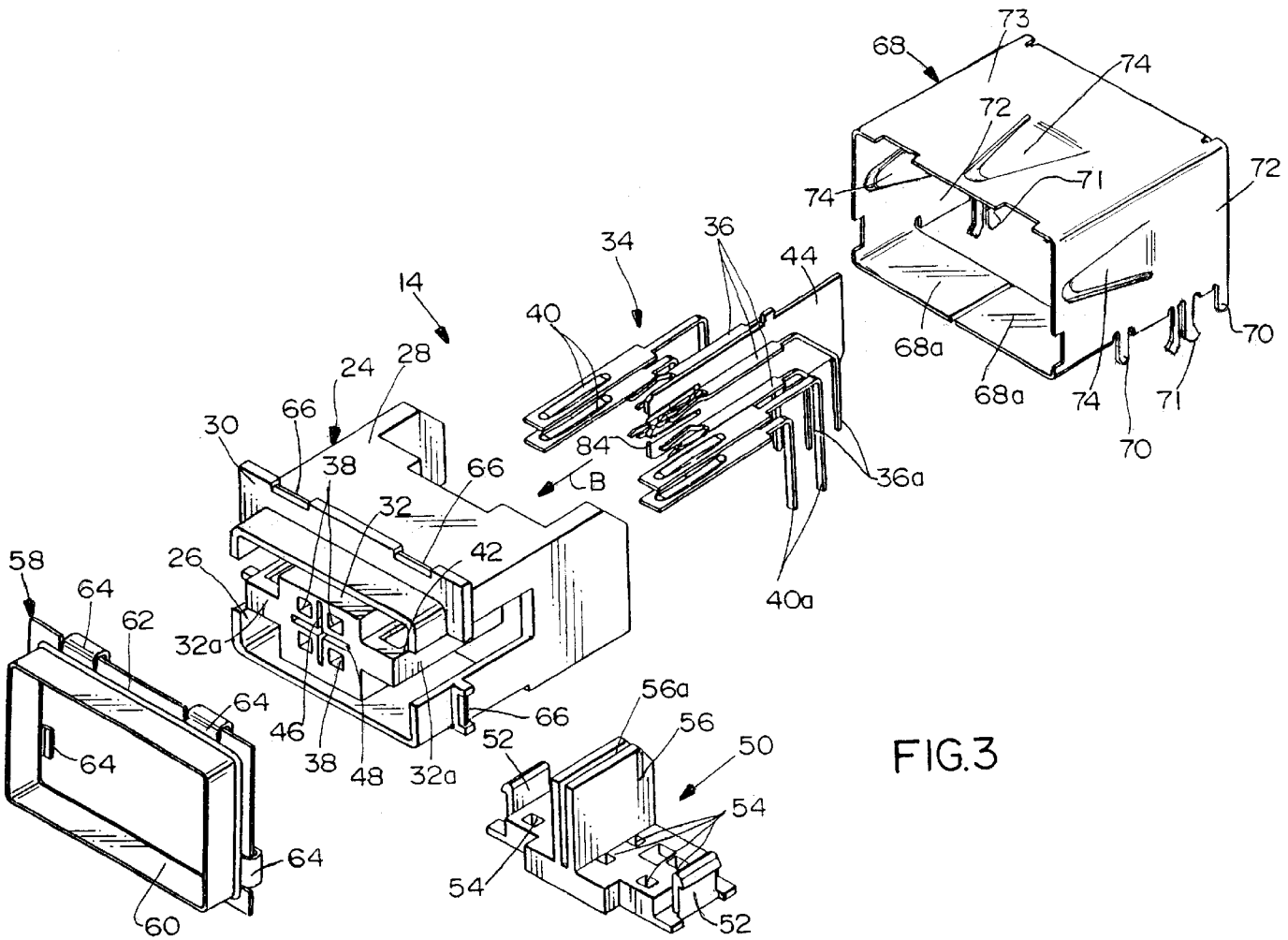
FIG. 3 is an exploded perspective view of the components of the receptacle connector.

Referring to FIG. 3 in conjunction with FIGS. 1 and 2, receptacle connector 14 generally includes a dielectric housing, generally designated 24, which is molded of plastic material or the like. The dielectric housing has a rectangular forward mating end 26 and a rearward end 28 with an outwardly projecting peripheral flange 30 therebetween. The housing also has a forwardly projecting, internal mating portion 32 having laterally outwardly extending wing portions 32*a*.

Receptacle connector 14 has a terminal array, generally designated 34, for mounting in dielectric housing 24. The terminal array includes four signal female terminals 36 positionable into four terminal-receiving passages 38 in housing 24 in the direction of arrow "B" (FIG. 3). The terminal array includes four blade-like power terminals 40 insertable into open grooves 42 on opposite sides of wings 32*a* of mating portion 32 of the housing. Signal terminals 36 have tail portions 36a and power terminals 40 have tail portions 40*a* for insertion into appropriate holes in printed circuit board 18 and for solder connection to circuit traces on the board and/or in the holes. Signal terminals 36 are divided vertically by a ground plate 44 insertable into a vertical slot 46 in mating portion 32 of the housing. It can be seen in FIG. 3 that a horizontal slot 48 intersects vertical slot 46 to form a cross configuration.

Receptacle connector 14 includes a tail aligner, generally designated 50, which has hooked latch arms 52 for snappingly assembling the tail aligner to the underside of dielectric housing 24 at the rearward end thereof. The tail aligner includes four tail aligning holes 54 on each opposite side of a slotted partition 56 for receiving tail portions 36*a* and 40*a* of signal terminals 36 and power terminals 40, respectively. Partition 56 includes a vertical slot 56*a* for receiving ground plate 44.

Receptacle connector 14 includes a front ESD shield, generally designated 58, which is positioned about the exterior of forward mating end 26 of dielectric housing 24. Shield 58 is a one-piece structure drawn of conductive sheet metal material. More particularly, the ESD shield includes a rectangular shroud 60 projecting forwardly of a generally planar peripheral flange 62. Shroud 60 is sized and shaped for positioning around rectangular forward mating end 26 of the dielectric housing and, flange 62 is adapted for abutting against the front face of peripheral flange 30 of the housing. A plurality of retention tabs 64 are bent through notches 66 in housing flange 30 to embrace the flange and secure or fix front ESD shield 58 to the housing.

Receptacle connector 14 further includes a rear EMI shield, generally designated 68. Shield 68 is a one-piece structure stamped and formed of conductive sheet metal material. The rear EMI shield is generally rectangular or box-shaped for positioning substantially entirely about rearward end 28 of dielectric housing 24, i.e., about substantially the entire housing rearwardly of outwardly projecting peripheral flange 30 of the housing. EMI shield 68 has a pair of retention tabs 68*a* that wrap around a lower portion of housing 24. Along each side wall 72 of the EMI shield are a pair of tail portions 70 depending downwardly from the side walls as well as a fork lock 71 for insertion into appropriate mounting holes in printed circuit board 18. Tails 70 and fork locks 71 not only function as mounting posts for the connector, but they are electrically connected to ground circuit traces on the printed circuit board as by soldering to the ground traces on the board and/or in the mounting holes. Lastly, rear EMI shield 68 includes a inwardly bowed spring arms 74 stamped and formed out of side walls 72 and top wall 73 for engaging an external shield of plug connector 16, as will be described hereinafter.

In function, front ESD shield 58 which is positioned about the exterior of at least a substantial portion of forward mating end 26 of dielectric housing 24 operates to dissipate electrostatic discharges from mating plug connector 16 as well as any electrical discharges from the power terminals of the plug connector. The front ESD shield will also dissipate any electrical discharges from extraneous objects such as tools which are inappropriately inserted into receptacle connector 14 and which may engage power terminals 40 which are visible through the front of the connector as seen in FIG. 1. The front ESD shield extends through aperture 20 in conductive bracket 22 and is in full engagement with the bracket for dissipating charges thereto. The front ESD shield 58 will also function as an EMI shield to a certain extent.

Rear EMI shield 68 is effective to protect the terminal interface area of terminal array 34 from externally emitted radiations as well as to prevent internal radiations from being emitted externally of the connector to other electrical components, such as adjacent components on printed circuit board 18. The rear EMI shield is disposed about the exterior of substantially the entire rearward end 28 of dielectric housing 24 rearwardly of flange 30.

Front ESD shield 58 is electrically isolated from rear EMI shield 68 by outwardly projecting peripheral flange 30 of dielectric housing 24. In essence, the dielectric flange physically and electrically separates the two one-piece shields so that front ESD shield 58 can be grounded to conductive bracket 22 and rear EMI shield 68 can be independently grounded to printed circuit board 18.

In order to maximize the shielding provided by rear EMI shield 68 yet ensure that it is electrically isolated from front ESD shield 58, the front edge of the rear shield includes rectangular recesses 75. These recesses 75 are aligned with retention tabs 64 and ensure that the front and rear will not contact each other. In the alternative, the entire leading or front edge of front ESD shield 58 could be designed so as not to extend as far towards flange 30 in which case the recesses could be eliminated.

Figure 4:
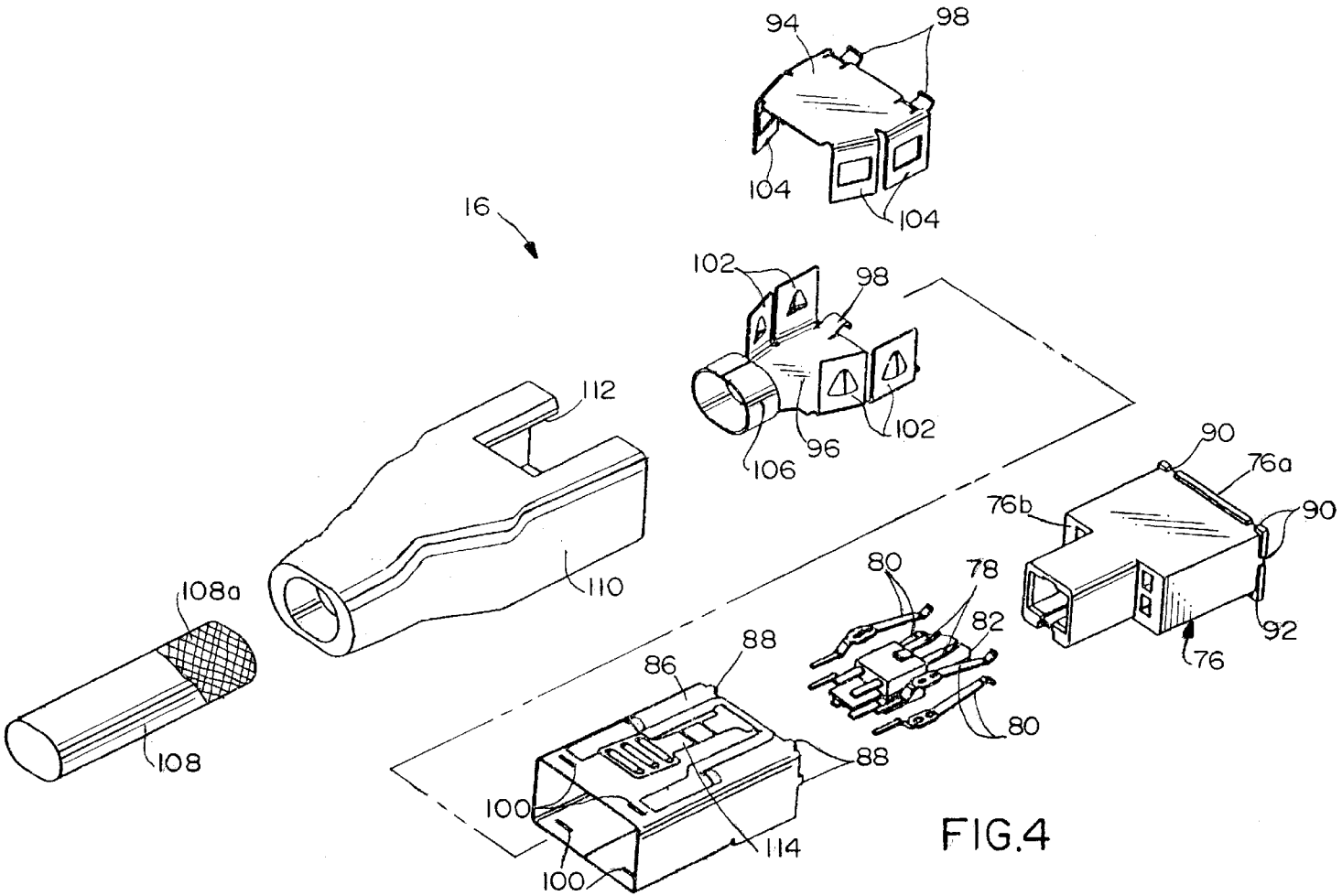
FIG. 4 is an exploded perspective view of the components of the plug connector.
Figure 5:
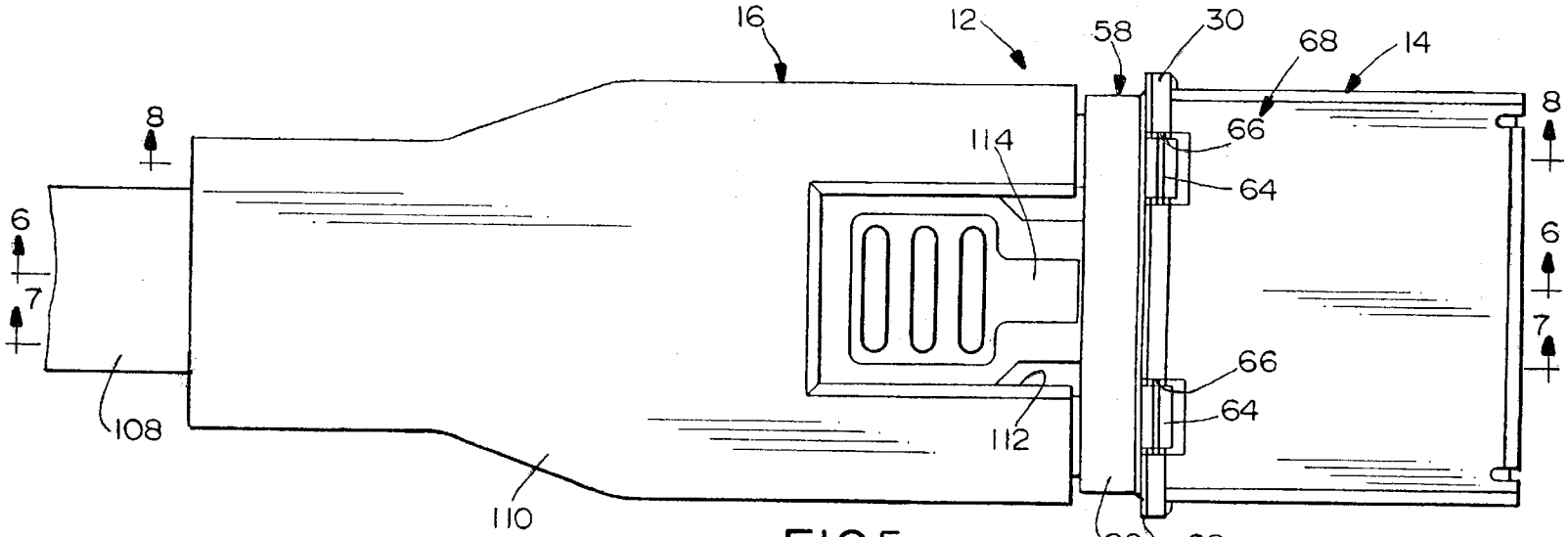
FIG. 5 is a top plan view of the connector assembly in assembled condition.
Figure 6:
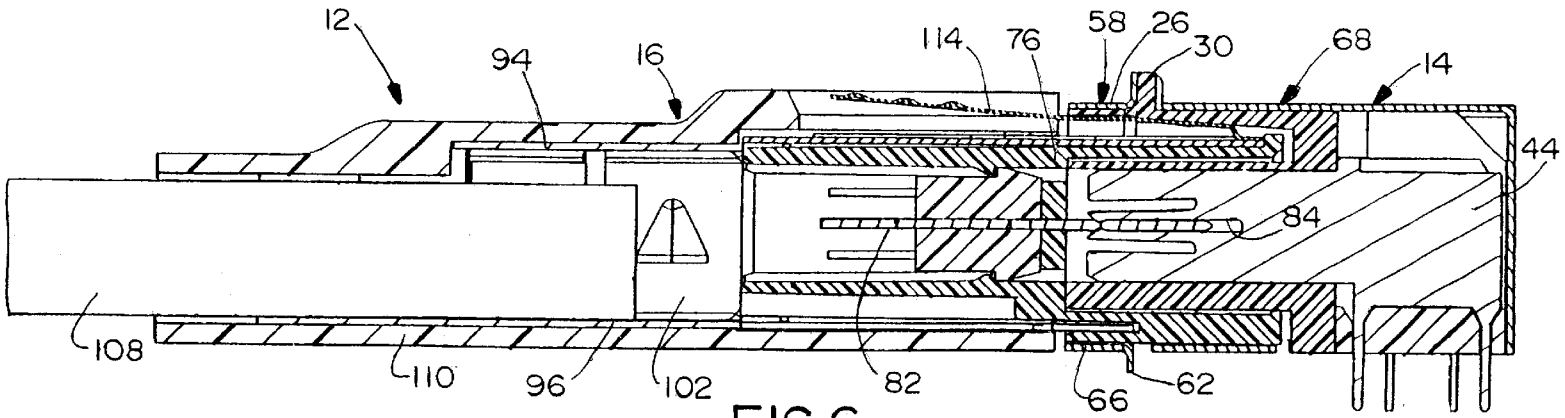
FIG. 6 is a vertical section taken generally along line 6—6 of FIG. 5.
Figure 8:
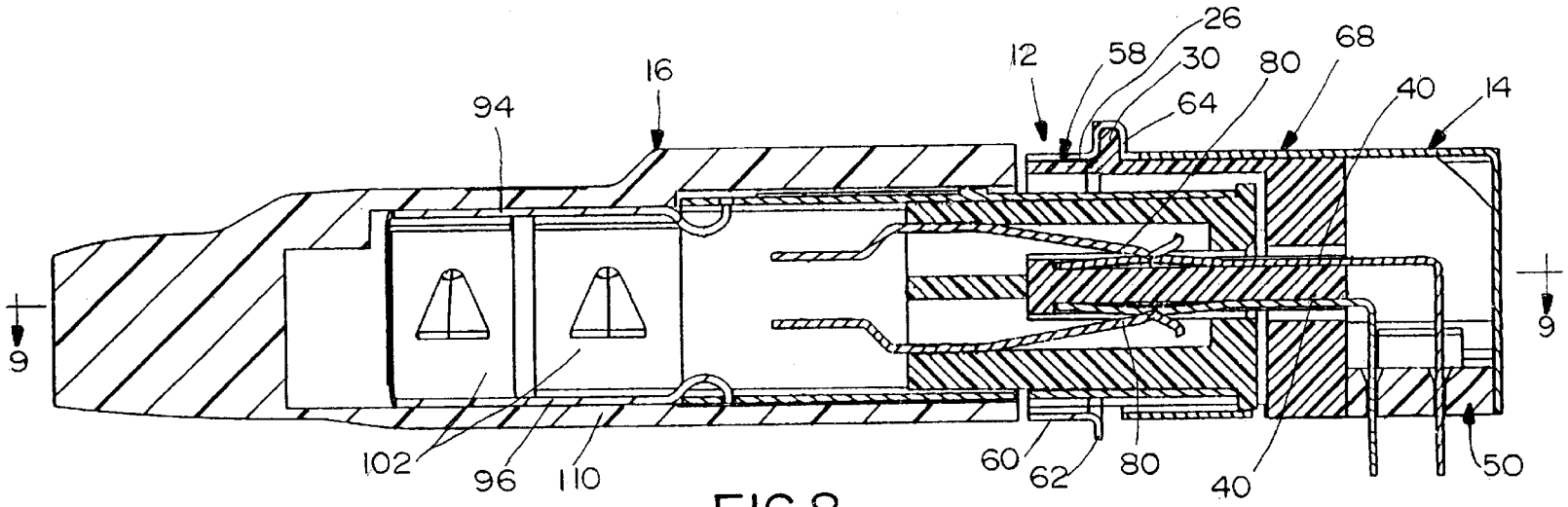
FIG. 8 is a vertical section taken generally along line 8—8 of FIG. 5.

Referring to FIG. 4 in conjunction with FIGS. 1 and 2, plug connector 16 includes a dielectric housing, generally designated 76, which includes a forward mating end 76*a* and a rearward end 76*b*. Four signal terminals 78 are mounted in the housing for electrical connection to signal terminals 36 of receptacle connector 14. Four power terminals 80 are mounted in the housing for electric connection to power terminals 40 of the receptacle connector. A ground plate 82 horizontally separates the signal terminals and is inserted into slot 48 in mating portion 32 of the receptacle connector. Horizontal ground plate 82 also is positioned into a slot 84 (FIG. 3) in vertical ground plate 44 of the receptacle connector to define a cross-shaped ground plate configuration.

Plug connector 16 has a shield structure which includes a generally rectangular, box-shaped shield 86 which is positionable over substantially the entire dielectric housing 76. Shield 86 is a one-piece structure stamped and formed of sheet metal material and includes a plurality of forwardly projecting positioning tabs 88 which are positioned in notches 90 of a peripheral flange 92 at the front mating end 76*a* of dielectric housing 76.

The shield structure of plug connector 16 also includes a rear outer shell having a top shell half 94 and a bottom shell half 96. The shell halves are stamped and formed of sheet metal material and have forwardly projecting retention hooks 98 which are positioned into retention slots 100 of shield 86 to secure the shell halves to the shield. Hooks 98 are rotated into slots 100, as shell halves 94 and 96 are pivoted toward each other so that latch arms 102 of bottom shell half 96 snap into engagement with latch arms 104 of top shell half 96 to completely enclose the rearward end of dielectric housing 16. Bottom shell half 96 includes a crimping structure 106 for clamping onto the outside of an electrical cable 108.

Plug connector 16 includes an insulative boot 110 which is overmolded about the rear end of shield 86, about the entirety of shell halves 94 and 96 and about the interface area between cable 108 and the connector. The overmolded boot not only forms an insulating layer about the rear of the connector, but the boot provides a strain relief for cable 108. As seen in FIGS. 1 and 2, the boot stops short of the forward mating end 76*a* of the dielectric housing to expose the front area of shield 86. The boot also has a cutout 112 at the front thereof for accommodating a spring latch arm 114 of shield 86.

In plug connector 16, shield 86 is grounded through shell halves 94 and 96 to a ground braid 108*a* which is included within cable 108. Therefore, shield 86 can act both as an ESD shield as well as an EMI shield.

Figure 9:
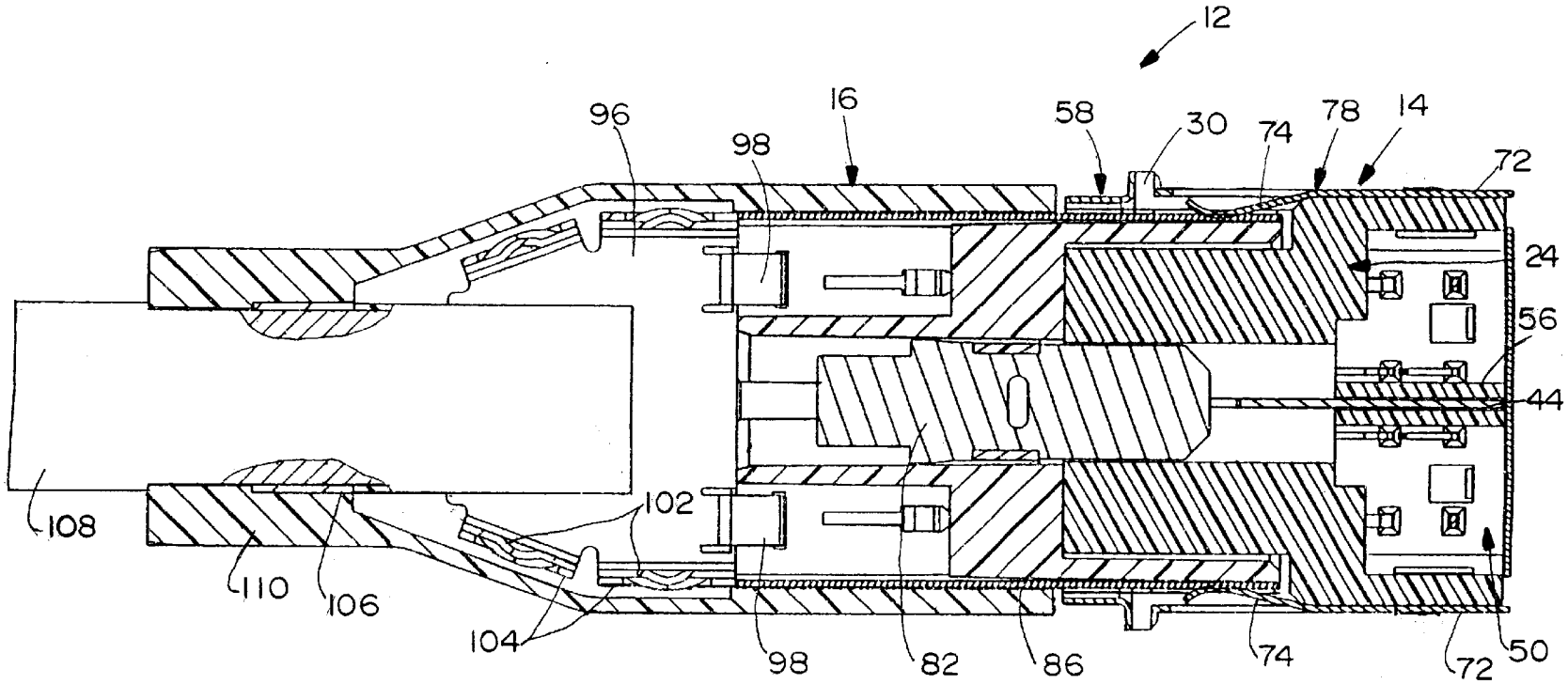
FIG. 9 is a horizontal section taken generally along line 9—9 of FIG. 8.
Figure 10:
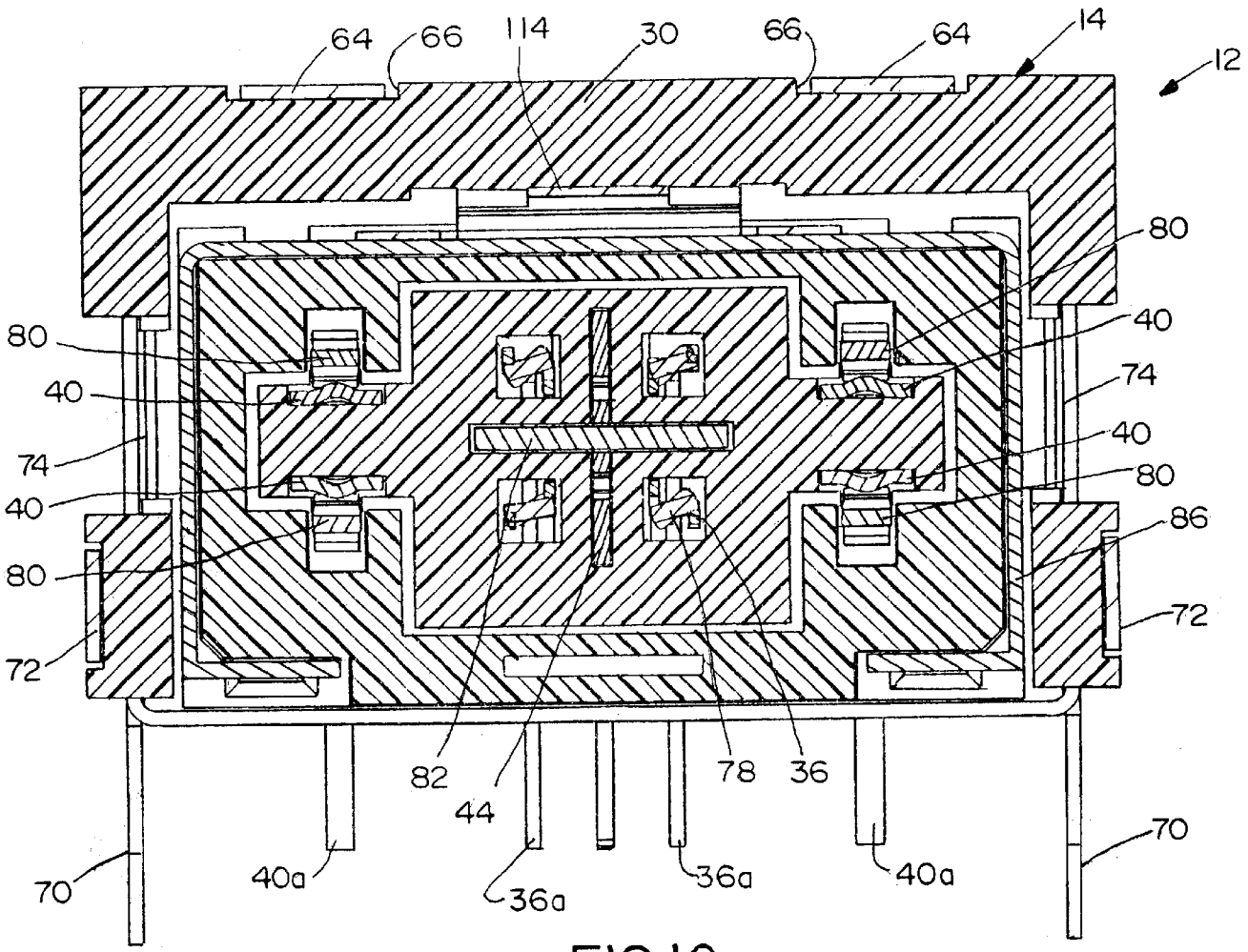
FIG. 10 is a vertical section taken generally along line 10—10 of FIG. 7.

FIGS. 5–10 show considerable details of connector assembly 12, including receptacle connector 14 and plug connector 16, in a fully assembled condition. Details of the cable 108 and the interrelationship between the signal terminals, the power terminals and the cross-shaped ground plates 44 and 82 will not be described herein. If desirable or necessary, these details can be derived from copending application Ser. No. 08/783,418, filed Jan. 14, 1997, which is assigned to assignee of the present invention and which is incorporated herein by reference. Suffice it to say, FIGS. 5–9 clearly show how outwardly projecting peripheral flange 30 of dielectric housing 24 of receptacle connector 14 electrically isolates front ESD shield 58 from rear EMI shield 68 of the receptacle connector. FIG. 9 shows how spring arms 74 of rear EMI shield 68 of receptacle connector 14 engage the sides of shield 86 of plug connector 16.

Figure 7:
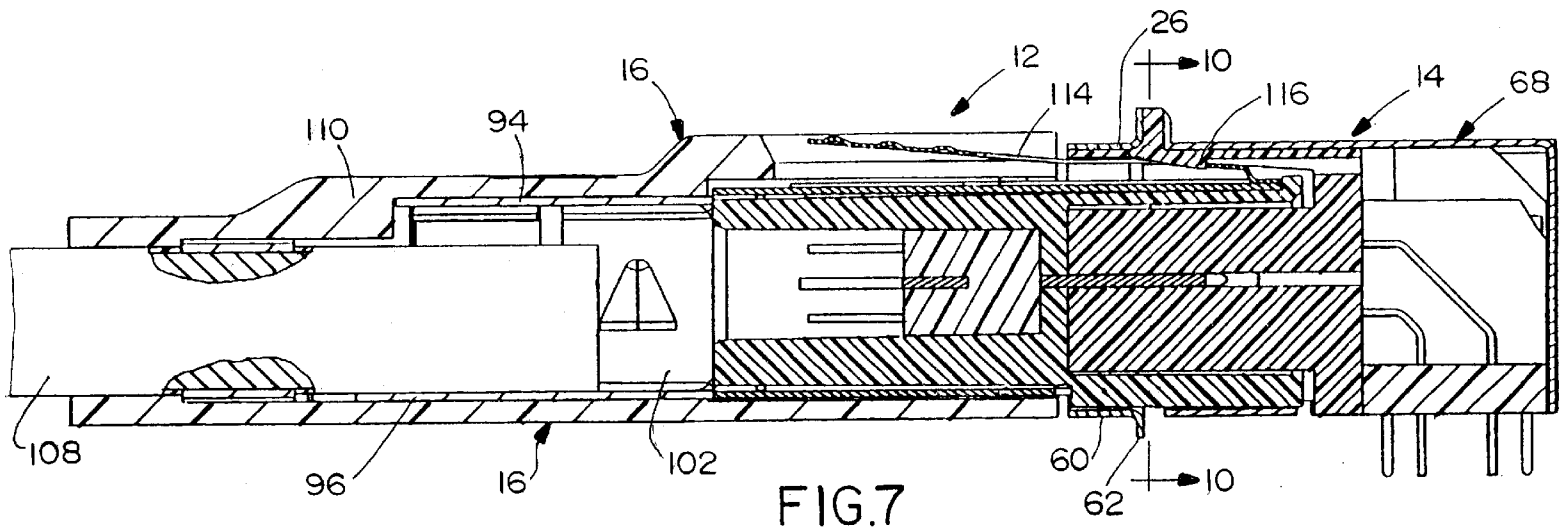
FIG. 7 is a vertical section taken generally along line 7—7 of FIG. 5.

FIG. 7 shows that the dielectric housing of receptacle connector 14 includes an internal latch shoulder 116 for engaging spring latch arm 114 of plug connector 16. More particularly, as best seen in FIGS. 1, 2 and 4, latch arm 114 is cantilevered rearwardly from a forward end of shield 86 of plug connector 16. With shield 86 being stamped and formed of sheet metal material, the latch arm is folded back from the forward edge of the metal shield. The latch arm includes an enlarged head portion 114*a* at the distal end thereof. The base of the cantilevered latch arm also is enlarged to define a pair of outwardly projecting, rearwardly facing latch shoulders 114*b*. Now, referring to FIG. 7, latch shoulders 114*b* of the latch arm actually are adapted for engaging a pair of the internal latch shoulders 116 on the inside of the dielectric housing at the forward mating end of receptacle connector 14. It also can be seen in FIG. 7 how the enlarged distal end 114*a* of the latch arm projects through cutout 112 in boot 110 so that an operator can depress the latch arm and disengage the complementary interengaging latch means provided by latch shoulders 114*b*and 116 to unmate the connectors. Therefore, peripheral metal shield 86 of plug connector 16 remains isolated from either of the shields of receptacle connector 14, because latch arm 114 of the plug connector interengages with the dielectric housing of the receptacle connector.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

What is claimed is:

1. A shielded electrical connector, comprising:

a dielectric housing having a forward mating end and a rearward end;

a front ESD shield about the exterior of at least a substantial portion of the forward mating end of the dielectric housing;

a rear EMI shield about the exterior of at least a substantial portion of the rearward end of the dielectric housing; and wherein the front ESD shield is electrically isolated from the rear EMI shield by an outwardly projecting portion of the dielectric housing physically separating the shields.

2. The shielded electrical connector of claim 1 wherein said forward mating end of the housing includes a receptacle portion for receiving a plug portion of a complementary mating connector, the front ESD shield being disposed about said receptacle portion, with the receptacle portion forming a dielectric barrier between the ESD shield and the plug portion of the complementary mating connector.

3. The shielded electrical connector of claim 2 wherein said receptacle portion is generally rectangular, and the ESD shield includes a rectangular shroud surrounding the rectangular receptacle portion.

4. The shielded electrical connector of claim 1 wherein said front ESD shield includes at least one retention portion for locking the shield to said outwardly projecting portion of the dielectric housing.

5. The shielded electrical connector of claim 1 wherein said outwardly projecting portion of the dielectric housing comprises a peripheral flange.

6. The shielded electrical connector of claim 5 wherein said front ESD shield includes at least one retention tab embracing said peripheral flange for fixing the ESD shield to the housing.

7. In combination with the shielded electrical connector of claim 1, a complementary mating connector including a peripheral metal shield, and complementary interengaging latch means between the peripheral metal shield of the mating connector and the dielectric housing of the shielded electrical connector.

8. The combination of claim 7 wherein said complementary interengaging latch means comprises a latch member inside the forward mating end of the dielectric housing.

9. The combination of claim 7 wherein said complementary interengaging latch means comprises a latch arm folded back from a forward end of said peripheral metal shield.

10. The combination of claim 9 wherein said complementary interengaging latch means comprises a latch member inside the forward mating end of the dielectric housing.

11. A shielded electrical connector assembly, comprising:

a dielectric housing having a forward mating end and a rearward end;

a front ESD shield about the exterior of at least a substantial portion of the forward mating end of the dielectric housing, the front ESD shield being adapted for engaging an aperture in a conductive bracket;

a rear EMI shield about the exterior of at least a substantial portion of the rearward end of the dielectric housing, the rear EMI shield having ground means adapted for engaging a ground circuit on a printed circuit board; and wherein the front ESD shield is electrically isolated from the rear EMI shield by an outwardly projecting portion of the dielectric housing physically separating the shields.

12. The shielded electrical connector of claim 11 wherein said forward mating end of the housing includes a receptacle portion for receiving a plug portion of a complementary mating connector, the front ESD shield being disposed about said receptacle portion, with the receptacle portion forming a dielectric barrier between the ESD shield and the plug portion of the complementary mating connector.

13. The shielded electrical connector of claim 12 wherein said receptacle portion and the surrounding ESD shield are sized for insertion through the aperture in the conductive bracket.

14. The shielded electrical connector of claim 13 wherein said receptacle portion is generally rectangular, and the ESD shield includes a rectangular shroud surrounding the rectangular receptacle portion.

15. The shielded electrical connector of claim 11 wherein said ground means comprises tails for connection to the ground circuit on the printed circuit board.

16. The shielded electrical connector of claim 11 wherein said front ESD shield includes at least one retention portion for locking the shield to said outwardly projecting portion of the dielectric housing.

17. The shielded electrical connector of claim 11 wherein said outwardly projecting portion of the dielectric housing comprises a peripheral flange.

18. The shielded electrical connector of claim 17 wherein said front ESD shield includes at least one retention tab embracing said peripheral flange for fixing the ESD shield to the housing.

19. In combination with the shielded electrical connector of claim 11, a complementary mating connector including a peripheral metal shield, and complementary interengaging latch means between the peripheral metal shield of the mating connector and the dielectric housing of the shielded electrical connector.

20. The combination of claim 19 wherein said complementary interengaging latch means comprises a latch member inside the forward mating end of the dielectric housing.

21. The combination of claim 19 wherein said complementary interengaging latch means comprises a latch arm folded back from a forward end of said peripheral metal shield.

22. The combination of claim 21 wherein said complementary interengaging latch means comprises a latch member inside the forward mating end of the dielectric housing.

23. A shielded electrical connector assembly, comprising:

a receptacle connector including a dielectric housing having a forward mating end and a shield about the exterior of at least a portion of the forward mating end of the dielectric housing;

a plug connector including a dielectric housing having a forward mating end insertable into the forward mating end of the housing of the receptacle connector, and a peripheral metal shield about the exterior of at least a portion of the dielectric housing of the plug connector; and complementary interengaging latch means between the peripheral metal shield of the plug connector and the dielectric housing of the receptacle connector isolating the peripheral metal shield of the plug connector from the shield at the forward mating end of the receptacle connector.

24. The shielded electrical connector assembly of claim 23 wherein said complementary interengaging latch means comprises a latch member inside the forward mating end of the dielectric housing of the receptacle connector.

25. The shielded electrical connector assembly of claim 23 wherein said complementary interengaging latch means comprises a latch arm folded back from a forward end of the peripheral metal shield of the plug connector.

26. The shielded electrical connector assembly of claim 25 wherein said complementary interengaging latch means comprises a latch member inside the forward mating end of the dielectric housing of the receptacle connector.

* * * * *